US005718070A

United States Patent [19]

Ruvang

[11] Patent Number: 5,718,070

[45] Date of Patent: Feb. 17, 1998

[54] SELF-ADJUSTING TOOTH/ADAPTER CONNECTION SYSTEM FOR MATERIAL DISPLACEMENT APPARATUS

[75] Inventor: John A. Ruvang, Carrollton, Tex.

[73] Assignee: GH Hensley Industries, Inc., Dallas, Tex.

[21] Appl. No.: 729,052

[22] Filed: Oct. 10, 1996

Related U.S. Application Data

[63] Continuation-in-part of Ser. No. 556,701, Nov. 13, 1995, Pat. No. 5,564,206.

[51] Int. Cl.[6] ..... E02F 2/98

[52] U.S. Cl. ..... 37/459; 37/455

[58] Field of Search ..... 37/455, 456, 457, 37/458, 459; 411/554, 552, 347, 349

[56] References Cited

U.S. PATENT DOCUMENTS

| | | | |
|---|---|---|---|
| 943,775 | 12/1909 | Exton et al. . | |
| 1,021,135 | 3/1912 | Clark . | |
| 1,188,480 | 6/1916 | Pemberton . | |
| 1,548,374 | 8/1925 | Mullally . | |
| 1,571,782 | 2/1926 | Andrews | 37/455 |
| 1,787,695 | 1/1931 | McKee | 37/455 |
| 1,870,044 | 8/1932 | Fellmeth | 37/455 |
| 1,917,431 | 7/1933 | Clark . | |
| 2,181,675 | 11/1939 | Watson | 37/191 |
| 2,393,706 | 1/1946 | Page | 37/455 |
| 2,576,225 | 11/1951 | Hostetter | 37/459 |
| 2,635,366 | 3/1953 | Hostetter | 37/459 |
| 2,702,490 | 2/1955 | Launder | 85/8.3 |
| 3,019,537 | 2/1962 | Stephenson | 37/457 |
| 4,663,867 | 5/1987 | Hahn et al. | 37/459 |
| 5,205,057 | 4/1993 | Garman | 37/458 |
| 5,272,824 | 12/1993 | Cornelius | 37/458 |
| 5,410,826 | 5/1995 | Immel et al. | 37/455 X |
| 5,452,529 | 9/1995 | Neuenfeldt et al. | 37/455 |

FOREIGN PATENT DOCUMENTS

| | | | |
|---|---|---|---|
| 605679 | 9/1960 | Canada | 37/458 |
| 2601797 | 7/1976 | Germany | 37/455 |
| 565417 | 11/1944 | United Kingdom | 37/458 |

*Primary Examiner*—Randolph A. Reese
*Assistant Examiner*—Thomas A. Beach
*Attorney, Agent, or Firm*—Konneker & Smith

[57] ABSTRACT

An excavation tooth point longitudinally extending along an axis and having a pocket area extending inwardly through a rear end thereof is telescoped onto a nose portion of an adapter structure by inserting the nose portion into the tooth point pocket area. The inserted nose portion has a tapered side opening therein that is positioned between a corresponding pair of similarly tapered tooth side wall openings. The tooth point is removably coupled to the adapter nose using an elongated, wedge shaped connector member which is inserted, small end first, through the generally aligned tooth and adapter openings. An internal passage longitudinally extends through the large connector member end and receives an inner portion of a force exerting member which compresses a spring within the passage, the spring in turn resiliently biasing an outer portion of the force exerting member into abutment with an interior surface portion of the tooth. The compressed spring, via the force exerting member, maintains the tooth point in an axially tightened orientation on the adapter nose, and automatically tightens the tooth further onto the adapter nose in response to tooth/adapter interface wear that would otherwise cause undesirable "play" between the tooth point and the adapter nose portion. The connector member may be removed by pushing the force exerting member further into the connector member passage, rotating it, and then releasably locking it in this retracted position using a cooperating pin and slot structure on the connector and force exerting members.

23 Claims, 3 Drawing Sheets

SELF-ADJUSTING TOOTH/ADAPTER CONNECTION SYSTEM FOR MATERIAL DISPLACEMENT APPARATUS

CROSS-REFERENCE TO RELATED APPLICATION

This application is a continuation-in-part of U.S. application Ser. No. 08/556,701 filed on Nov. 13, 1995 now U.S. Pat. No. 5,564,206 and hereby incorporated in its entirety herein by reference.

BACKGROUND OF THE INVENTION

The present invention generally relates to material displacement apparatus and, in a preferred embodiment thereof, more particularly relates to apparatus for releasably coupling a replaceable excavation tooth point to an associated adapter nose structure.

A variety of types of material displacement apparatus are provided with replaceable portions that are removably carried by larger base structures and come into abrasive, wearing contact with the material being displaced. For example, excavating tooth assemblies provided on digging equipment such as excavating buckets or the like typically comprise a relatively massive adapter portion which is suitably anchored to the forward bucket lip and has a reduced cross-section, forwardly projecting nose portion, and a replaceable tooth point having formed through a rear end thereof a pocket opening that releasably receives the adapter nose. To captively retain the point on the adapter nose, aligned transverse openings are formed through these interengageable elements adjacent the rear end of the point, and a suitable connector structure is driven into and forcibly retained within the aligned openings to releasably anchor the replaceable tooth point on its associated adapter nose portion.

These connector structures adapted to be driven into the aligned tooth point and adapter nose openings typically come in two primary forms—(1) wedge and spool connector sets, and (2) flex pin connectors. A wedge and spool connector set comprises a tapered spool portion which is initially placed in the aligned tooth and adapter nose openings, and a tapered wedge portion which is subsequently driven into the openings, against the spool portion, to jam the structure in place within the openings in a manner exerting high rigid retention forces on the interior opening surfaces and press the nose portion into a tight fitting engagement with the tooth socket.

Very high drive-in and knock-out forces are required to insert and later remove the steel wedge and typically require a two man effort to pound the wedge in and out—one man holding a removal tool against an end of the wedge, and the other man pounding on the removal tool with a sledge hammer. This creates a safety hazard due to the possibility of flying metal slivers and/or the second man hitting the first man instead of the removal tool with the sledge hammer. Additionally, wear between the tooth/adapter nose surface interface during excavation use of the tooth tends to loosen the tight fit of the wedge/spool structure within the tooth and adapter nose openings, thereby permitting the wedge/spool structure to fall out of the openings and thus permitting the tooth to fall off the adapter nose.

Flex pin structures typically comprise two elongated metal members held in a spaced apart, side-by-side orientation by an elastomeric material bonded therebetween. The flex pin structure is longitudinally driven into the tooth and adapter nose openings to cause the elastomeric material to be compressed and resiliently force the metal members against the nose and tooth opening surfaces to retain the connector structure in place within the openings and resiliently press the adapter nose portion into tight fitting engagement with the interior surface of the tooth socket.

Flex pins also have their disadvantages. For example, compared to wedge/spool structures they have a substantially lower in-place retention force. Additionally, reverse loading on the tooth creates a gap in the tooth and adapter nose openings through which dirt can enter the tooth pocket and undesirably accelerate wear at the tooth/adapter nose surface interface which correspondingly loosens the connector retention force. Further, the elastomeric materials typically used in flex pin connectors are unavoidably subject to deterioration from hot, cold and acidic operating environments. Moreover, in both wedge-and-spool and flex pin connector structures relatively precise manufacturing dimensional tolerances are required in the tooth point and adapter nose portions to accommodate the installation of their associated connector structures.

It can be seen from the foregoing that it would be desirable to provide improved excavating tooth connector apparatus that eliminates or at least substantially reduces the above-mentioned problems, limitations and disadvantages associated with conventional excavating tooth and other material displacement equipment connector apparatus of the general type described above. It is accordingly an object of the present invention to provide such improved connector apparatus.

SUMMARY OF THE INVENTION

In carrying out principles of the present invention, in accordance with a preferred embodiment thereof, a specially designed, self-tightening material displacement tooth and adapter assembly is provided. The assembly basically comprises an adapter structure, a replaceable tooth point, and self-tightening means.

The adapter structure has a base section with a tapered nose portion projecting outwardly therefrom along a first axis, the nose portion having a tapered connector opening extending therethrough in a direction transverse to the first axis.

The replaceable tooth point, representatively an excavation tooth point, is slidably and releasably telescoped on the nose portion and engages it along a tapered interface area which, in response to wear thereof, permits the tooth point to be slidably moved in a tightening direction toward the base section. The tooth point has an opposed pair of tapered side wall connector openings positioned on opposite sides of and generally aligned with the nose portion connector opening.

The self-tightening means are responsive to wear of the tooth point/nose portion interface area and are automatically operative to create movement of the tooth point in the tightening direction thereof. The self-tightening means include an elongated, generally wedge-shaped connector member longitudinally extending through the aligned tooth point and nose portion connector openings and slidably bearing on oppositely facing interior surface portions thereof.

The connector member has a first end and a smaller second end longitudinally spaced apart in a first direction from the first end. A recess extends longitudinally inwardly through the first end to an inner end surface of the recess, and opens outwardly through opposite sides of the connector member. Extending longitudinally inwardly from the inner recess end surface is an internal passage within the connector member.

Also forming a portion of the self-tightening means are force exerting means operative to continuously exert a resilient force on the connector member in the first direction in a manner causing it to urge the tooth point in the tightening direction thereof. In a preferred embodiment thereof, the force exerting means include a spring member received in the internal connector member passage, and a force exerting member disposed in an outwardly extended position and having a first portion received in the internal passage and compressing the spring member, and a second portion resiliently held in abutment with an interior surface portion of the tooth point by the compressed spring member and blocking removal of the connector from the tooth point and nose portion connector openings.

In a preferred embodiment of the tooth and adapter assembly, from its outwardly extended position the force exerting member is movable to an inwardly retracted position, by pushing the force exerting member further into the internal connector member passage, to further compress the spring member therein, and rotating the force exerting member about an axis parallel to the aforementioned first direction. This disengages the second portion of the force exerting member from the interior surface portion of the tooth point and permits removal of the connector member from the tooth point and nose portion connector openings.

The tooth and adapter assembly preferably also comprises cooperatively engageable means on the force exerting member and the connector member for releasably holding the force exerting member in its inwardly retracted position in response to movement of the force exerting member from its outwardly extended position to its inwardly retracted position. These cooperatively engageable means preferably include (1) a longitudinally extending exterior side surface guiding depression formed in the force exerting member, (2) a longitudinally spaced series of exterior side surface locking depressions formed in the force exerting member and extending generally transversely outwardly from the guiding depression, and (3) a locking projection formed on the connector member and extending generally transversely into its internal passage.

The locking projection is received in the guiding depression for movement along its length, and outwardly therefrom into a selected one of the locking depressions, in response to movement of the force exerting member from its outwardly extended position to its inwardly retracted position. When the projection is received in a selected locking depression, the force exerting member is precluded from longitudinal movement relative to the connector member.

The connector member is operatively installed in the telescoped tooth/adapter assembly by first pushing the force exerting member into the internal connector member passage, to compress the spring therein and bring the force exerting member to an inwardly retracted position thereof, and then rotating the force exerting member until the connector member projection is moved from the force exerting member guiding depression into one of its locking depressions, thereby releasably locking the force exerting member on the large end of the tapered connector member. The connector member is then inserted small end first into the aligned tooth and adapter nose openings until the second portion of the force exerting member is positioned inwardly of an interior surface portion of the tooth point.

Using a suitable tool brought into driving engagement with the second force exerting member portion, the force exerting member is then rotated to move the connector member projection back into the force exerting member guiding depression, thereby permitting the compressed spring to move the force exerting member longitudinally outwardly to bring a transversely outwardly projecting tab section of the second portion into an abutting, spring-biased engagement with a facing interior surface portion of the tooth point. With the force exerting member thus moved to its outwardly extended operative position within the assembly, the still-compressed spring member causes the force exerting member to continuously push the connector member into the aligned tooth/adapter openings and thereby resiliently force the tooth in a tightening direction along the adapter nose to automatically compensate for operating wear along the tooth point/adapter nose interface area.

To remove the connector member from the assembly, and thus permit removal of the tooth from the adapter nose, the operator simply pushes the force exerting member further into the internal connector passage, and rotates the force exerting member to again releasably lock it in an inwardly retracted position thereof. This, in turn, moves the force exerting member tab section out of its abutting and blocking relationship with the aforementioned interior surface portion of the tooth point, and permits the operator to longitudinally remove the connector member from the aligned tooth and adapter nose openings.

According to another feature of the invention the force exerting member locking depressions are configured to substantially prevent the connector member projection from being undesirably moved into one of the locking depressions during use of the assembly, thereby preventing the spring from automatically pushing the connector member further into the assembly to compensate for tooth/adapter nose interface area wear. Representatively, each of the locking depressions has (1) a circumferentially inner end portion which, from its juncture with the guiding depression, is longitudinally sloped toward the spring member, and (2) a circumferentially outer end portion which, from its juncture with the circumferentially inner locking depression end portion, is longitudinally sloped toward the spring member.

According to a further feature of the present invention, the interface area between the tooth point and the adapter nose has, in addition to the previously mentioned tapered portions, opposite surface portions positioned on opposite sides of and extending generally parallel to the tooth point axis. These parallel interface surface portions advantageously function to assure that if the connector member is unintentionally dislodged during use of the assembly, and the tooth point forcibly pulled off the adapter nose, the tooth point removal direction is essentially parallel to the tooth point axis, thereby preventing the tooth point from being rotated, and potentially damaging the adapter nose, as the tooth point is forced off the adapter nose.

DETAILED DESCRIPTION

Figure 1:
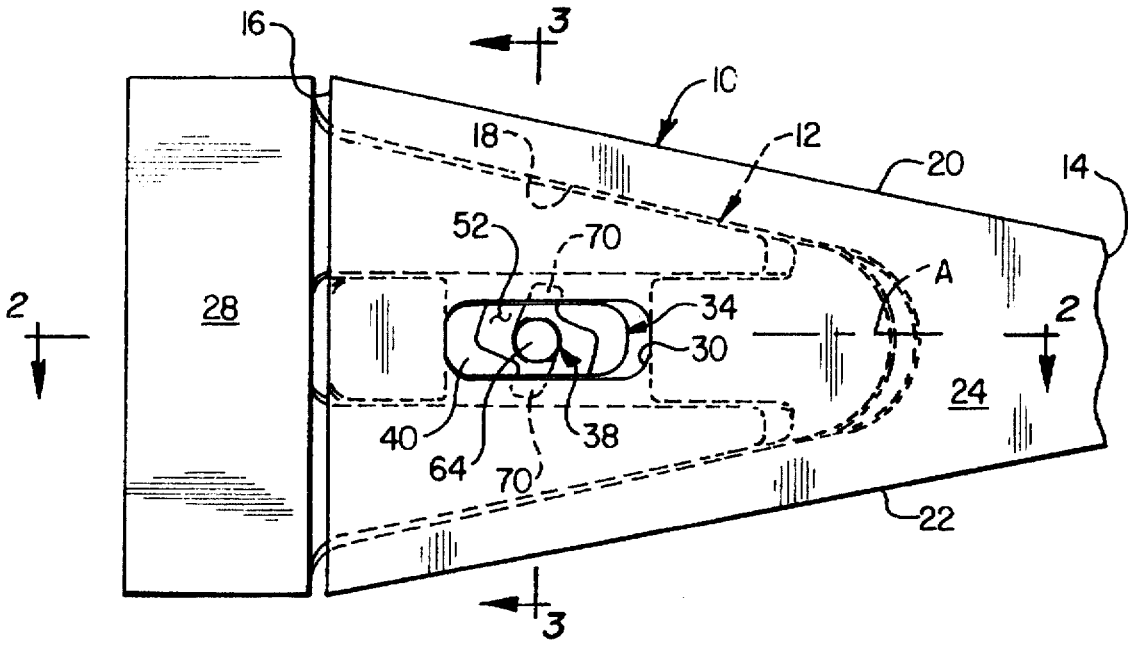
FIG. 1 is a partially phantomed, longitudinally foreshortened side elevational view of an excavation tooth/adapter nose assembly releasably coupled by a specially designed self-adjusting connection system embodying principles of the present invention.
Figure 2:
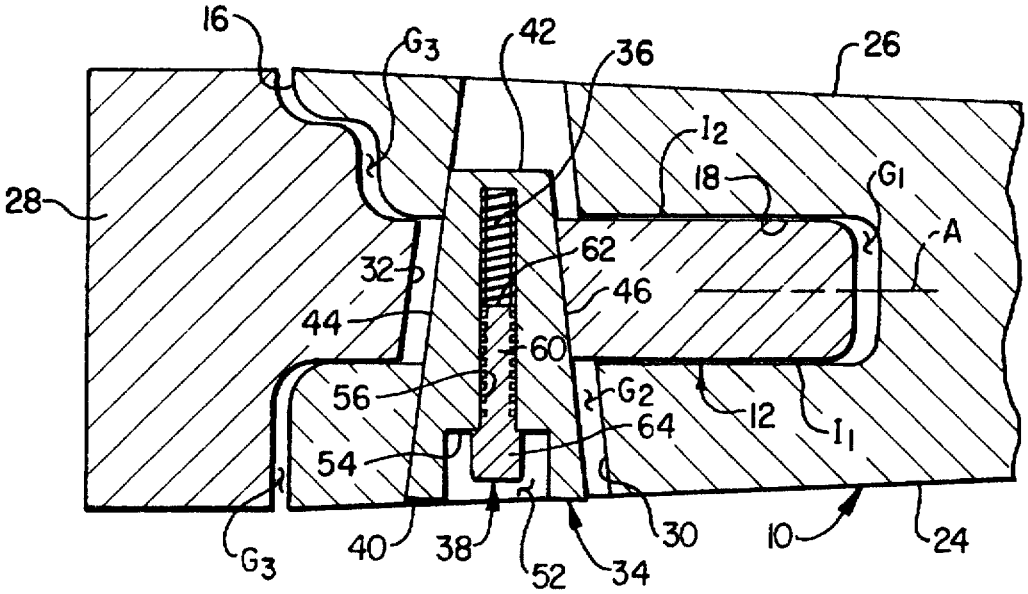
FIG. 2 is a cross-sectional view through the assembly taken along line 2—2 of FIG. 1.
Figure 3:
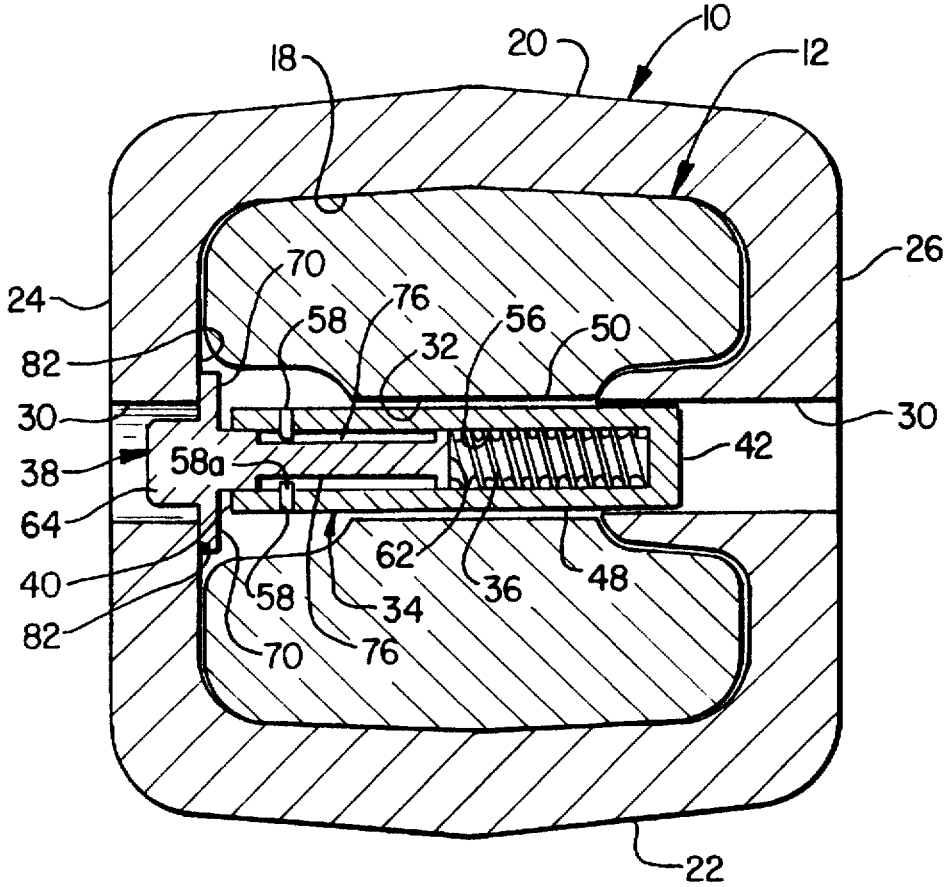
FIG. 3 is an enlarged scale cross-sectional view through the assembly taken along line 3—3 of FIG. 1.

Referring initially to FIGS. 1–3, the present invention provides, as subsequently described in detail herein, connection apparatus for removably joining a tooth point 10 to an associated adapter nose 12 for use in a material displacement operation such as an earth excavation task.

Removable tooth point 10 has an elongated, tapered body extending along a longitudinal axis A and having a pointed outer end 14; a wider inner end 16; a pocket area 18 extending from the inner end 16 into the interior of the tooth point 10; top and bottom sides 20,22; and left and right sides 24,26. Adapter nose 12 is configured to be complementarily and removably received in the tooth pocket area 18 and projects outwardly from a suitable support lip structure 28 such as that extending along the bottom side of an earth excavation bucket.

As illustrated in FIG. 2, the tooth point 10 has, adjacent its inner end 16, a tapered connection opening 30 extending between its opposite sides 24 and 26 and intersecting its internal pocket area 18. Opening 30 tapers inwardly toward the tooth side 26 as indicated. A similarly tapered connection opening 32 is formed in the adapter nose 12. When the adapter nose 12 is operatively received in the tooth pocket 18, the adapter nose opening 32 is communicated with opposite ends of the tooth connection opening 30 but is slightly offset therefrom toward the inner end 16 of the tooth point 10.

Referring now additionally to FIGS. 4A–6, the connection apparatus of the present invention, in the illustrated preferred embodiment thereof, has three parts—a flat, wedge shaped connector member 34, a coiled compression spring member 36, and a force exerting member 38.

The connector member 34 has a first end 40, a smaller second end 42, an opposite pair of sloping sides 44 and 46 extending between the first and second ends 40 and 42, and an opposite pair of generally parallel sides 48 and 50 extending between the sides 44 and 46. A recess 52 extends longitudinally inwardly through the first connector member end 40, has an inner end surface 54, and opens outwardly through the opposite sides 48,50 as at 52*a* and 52*b*. Extending longitudinally inwardly from the inner end surface 54 is a circularly cross-sectioned internal passage 56 that coaxially receives the compression spring member 36. Spring member 36 is captively retained within the internal passage 56 by an opposed pair of roll pins 58 that extend inwardly through suitable openings in the opposite sides 48,50 of the connector member 34. As best illustrated in FIG. 3, the roll pins 58 have inner end portions 58*a* that transversely project into the internal passage 56, adjacent the recess inner end surface 54 (see FIGS. 4A and 4B) and block removal of the spring outwardly from the internal passage 56 toward the first connector member end 40.

Figure 5:
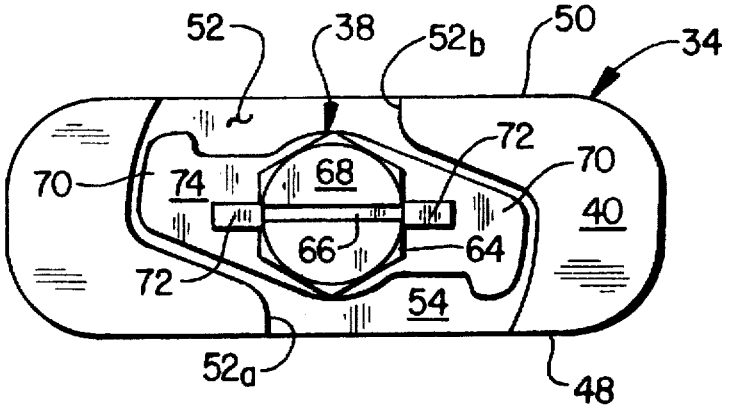
FIG. 5 is an enlarged scale end view of the connector member/force exerting member structure taken along line 5—5 of FIG. 4B.
Figure 6:
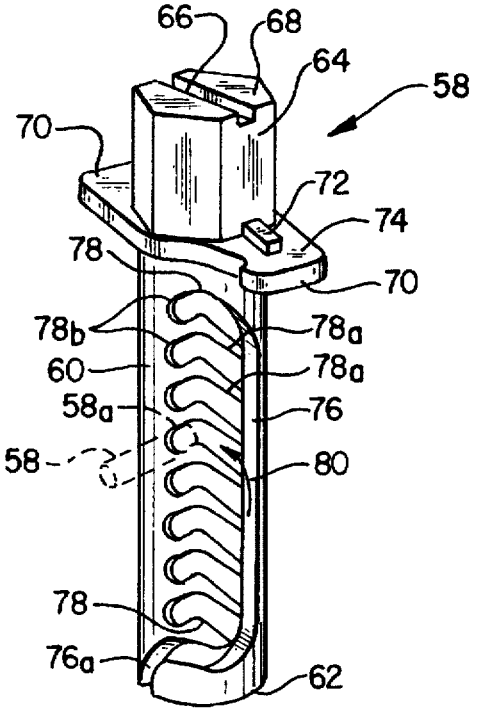
FIG. 6 is an enlarged scale simplified perspective view of the force exerting member removed from the connector member.

Turning now to FIGS. 5 and 6, the force exerting member 38 is representatively a one-piece metal structure having a cylindrical body 60 with an inner end 62, a transversely enlarged, hexagonally cross-sectioned outer end 64 with a screwdriver slot 66 formed in its outer end surface 68, and a blocking portion having two diametrically opposite tab sections 70 projecting transversely outwardly from the longitudinally inner end of the enlarged end portion 64. As illustrated, a pair of rectangular drive bosses 72 project upwardly from the outer side surfaces 74 of the tabs 70.

A pair of longitudinally extending guide depressions 76 (see FIGS. 3 and 6) are formed on diametrically opposite sides of the force exerting member body 60. As best illustrated in FIG. 6, each guide depression 76 has a bottom entrance/exit end portion 76*a* that opens outwardly through the inner body end 62. Extending generally transversely outwardly from each of the two guide depressions 76 are a series of locking depressions 78, one set of is visible in FIG. 6. For purposes later described herein, each locking depression 78 (as viewed in FIG. 6) has (1) a circumferentially inner end portion 78*a* which, from its juncture with its associated guiding depression 76, slopes upwardly away from the inner body end 62, and (2) a circumferentially outer end portion 78*b* which, from its juncture with its circumferentially inner end portion 78*a*, slopes downwardly toward the inner body end 62.

With reference now to FIGS. 4A–6, the force exerting member 38 is removably connectable to the connector member 34 by inserting the inner end 62 of the force exerting member body 60 inwardly through the connector member end recess 52, and into the internal passage 56 (see FIGS. 2 and 3), in an orientation in which the inner pin ends 58*a* enter the entrance/exit end portions 76*a* of the guiding depression 76. The force exerting member 38 is then rotated in a clockwise direction relative to the connector member 34 (as viewed from the top in FIGS. 4A–6) to cause the pin ends 58*a* to enter the main longitudinal portions of the guide depressions 76. Next, the body 60 of the force exerting member 38 is pushed further into the internal passage 56, thereby compressing the spring 36 and causing the pin ends 58*a* to move further up the guide depression 76 as viewed in FIG. 6. Finally, the force exerting member 38 is rotated in a counterclockwise direction (as viewed from above in FIGS. 4A–6) relative to the connector member 34 to cause the pin ends 58*a* to enter a diametrically opposite pair of the locking depressions 78 as illustrated in phantom, and by the arrow 80 in FIG. 6.

When the force exerting member body 60 is initially inserted into the internal passage 56, the tabs 70 are positioned to extend outwardly through the connector member recess side openings 52*a* and 52*b*. After the force exerting member 38 is then rotated to bring the pin ends 58*a* into the main longitudinal portions of the guide depressions 76, the tabs 70 are brought into abutment with and rotationally stopped by longitudinally extending surface portions of the recess side openings 52*a*,52*b*. In this orientation, the force exerting member 38 is in what may be termed an outwardly extended position relative to the connector member 34 as shown in FIG. 4B.

Figure 4A:
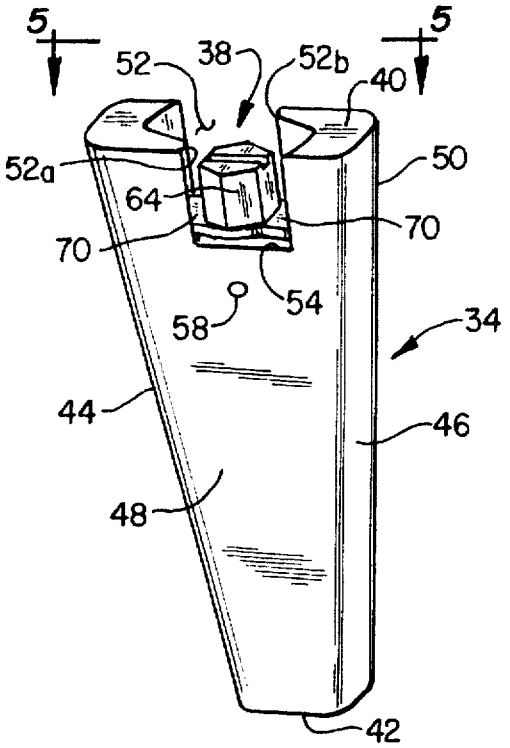
FIGS. 4A and 4B are enlarged scale, simplified perspective views of a connector member/force exerting member structure removed from the assembly, with the force exerting member being in an inwardly retracted release/insertion position thereof in FIG. 4A, and in an outwardly extended operative position thereof in FIG. 4B.
Figure 4B:
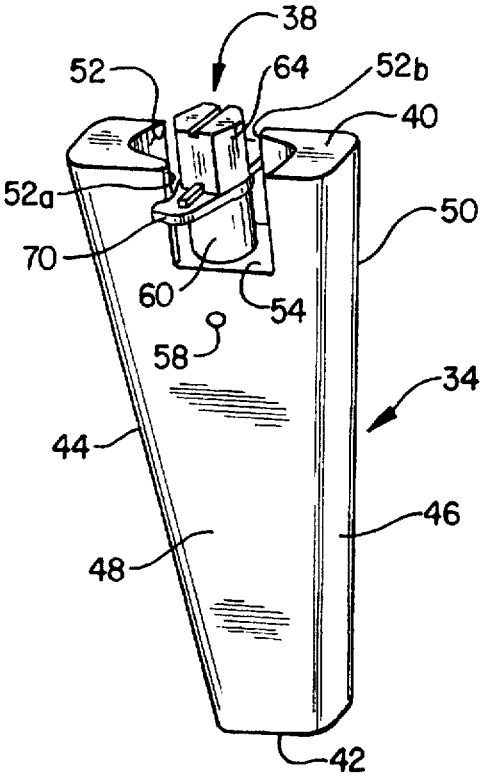

To ready the connector member/force exerting member structure 34,38 for operative insertion into the telescoped tooth/adapter structure 10,12 the force exerting member 38 is pushed further into the internal passage 56, thereby further compressing the spring 36 therein and moving the pin ends 58*a* further along the guiding depressions 76 toward the force exerting member end portion 64, and is then rotated again, as previously described herein, to cause the pin ends 58*a* to enter an opposed pair of the locking depressions 78, thereby locking the force exerting member 38 to the connector member 34 in what may be termed an inwardly retracted position as shown in FIG. 4A. In this orientation of the force exerting member (representatively fully inserted into the internal passage 56), the tabs 70 are fully disposed within the connector member end recess 52 as shown in FIGS. 4A and 5, and do not project outwardly through the recess side portions 52a,52b.

With the force exerting member 38 in this inwardly retracted orientation thereof shown in FIGS. 4A and 5, the connector member 34 is inserted, end 42 first, into the tooth and adapter nose openings 30,32 as indicated in FIG. 2. This positions the tabs 70 inwardly of an interior surface portion 82 of the tooth point 10 as shown in FIG. 3. Next the operator rotates the force exerting member 38 relative to the connector member 34 in a manner causing the pin ends 58a to be moved outwardly from their receiving pair of locking depressions 78 and into the main longitudinal portions of the guiding depressions, thereby also moving the tabs 70 outwardly through the connector member end recess side portions 52a and 52b (as illustrated in FIGS. 1, 3 and 4B) so that they face the interior tooth surface portion 82.

Finally, the operator releases the force exerting member 38 and allows the compressed spring to resiliently drive the force exerting member 38 outwardly from the internal passage 56 until the tabs 70 are brought into abutment with the facing interior tooth surface portion 82 at which point the force exerting member 38 is moved to its operative outwardly extended position shown in FIG. 3. As in the case of initially installing the force exerting member 38 on the connector member 34, the operator may forcibly rotate the force exerting member between its inwardly retracted and outwardly extended positions using, for example, a socket wrench to receive and drive the hexagonally cross-sectioned force exerting member end portion 64, a screwdriver inserted into the slot 66, or a spanner wrench used to operatively engage the rectangular bosses 72.

With the force exerting member 38 in this operative, outwardly extended position, the resilient spring force is transmitted through the force exerting member 38 to the wedge-shaped connector member 34 tending to resiliently push it further into the aligned tapered tooth point and adapter nose openings 30 and 32. In turn, this maintains a resilient tightening force on the tooth point 10 directed toward the adapter lip portion 28. Thus, in response to tooth point/adapter nose interface wear the tooth is continuously and automatically tightened on the adapter nose.

According to a feature of the present invention, the previously described angled configurations of the locking depressions 78 (see FIG. 6) on the force exerting member 38 advantageously inhibits operating loads imposed on the tooth/adapter assembly from driving the pin ends 58a out of the main longitudinal portions of the opposed guide depressions 76 into any of the locking depressions 78 to thereby terminate the outward, resiliently biased wear-adjusting movement of the force exerting member 38 relative to the connector member 34 and permit the tabs 70 to be rotated out of a facing relationship with the interior tooth surface portion 82 in a manner permitting the connector member 34 to simply fall out of the tooth point/adapter assembly.

Specifically, the angled configurations of these locking depressions requires that the force exerting member be pushed into the interior passage 56 against the force of the spring 36, as well as being rotated relative to the connector member, to move the pin ends 58a from the guide depressions 76 into any of the locking depressions 78. As will be appreciated, this substantially inhibits operating loads from effecting the movement of the pin ends 58a from the guide depressions 76 fully into any of the locking depressions 78, while at the same time permitting an operator to easily do so.

The connector system 34,36,38 provides several advantages over conventional wedge and spool connectors and resilient flex pin connector structures. First, the connector system of this invention is a non-impact system—i.e., it does not have to be driven into place using a sledge hammer or the like. Thus it is easier and safer to install. Second, it advantageously creates rigid resistance to undesirable movement of the tooth 10 axially toward and away from the adapter lip 28. Third, it provides for substantial increases in allowable fit/shift movement between the tooth and the adapter. Fourth, compared to resilient flex pin connector structures using various elastomeric materials therein, the connector system of the present invention (being all metal) is essentially impervious to high temperature, low temperature and acidic operating conditions.

It should be noted that the previously described self-tightening action, in which driven axial movement of the tooth 10 along the nose portion 12 toward the support lip structure 28 occurs due to the automatic action of the connector system 34,36 and 38, is permitted (as best illustrated in FIG. 2) by the various axial gaps $G_1$ between the right or forward end of the nose portion 12 and the inner end of the tooth pocket 18; $G_2$ between the forward or right side surface of the tapered opening 30; and the gaps $G_3$ between facing interior tooth and adapter surface portions of the assembly disposed leftwardly or rearwardly of the connector system 34,36,38. As will be appreciated, these gaps are generally as shown in FIG. 2 when the tooth point 10 is originally installed on the adapter nose portion 12, and horizontally decrease in width as tooth/adapter nose wear occurs and the tooth point 10 is automatically tightened leftwardly onto the nose portion 12 by the action of the connector structure 34,36,38.

An additional feature of the overall tooth/adapter/connector system assembly of the present invention is that, as best shown in FIG. 2, the telescoped tooth 10 and adapter nose portion 12 engage along a pair of spaced apart elongated surface interface areas $I_1$ and $I_2$ that are parallel to one another as well as being parallel to the longitudinal tooth axis A. This geometric feature of the invention advantageously eliminates bending stresses placed on the connector member 34, causing it to be loaded essentially entirely in shear in response to operational loads tending to pull the tooth 10 off the adapter nose 12.

Moreover, in the event that the connector member 34 somehow becomes dislodged from the tooth/adapter interior during use of the equipment, the tooth comes essentially straight off of the adapter (being guided in such essentially straight direction by the interface areas $I_1$ and $I_2$), thereby preventing the tooth from pivoting relative to the adapter and damaging it.

As can readily be seen from the foregoing, the connector system 34,36,38 of the present invention is of a simple, rugged construction, is relatively inexpensive to fabricate, and is quite simple, easy and safe to install in and remove from the tooth/adapter assembly. Additionally, the built-in wear compensation and tightening feature of the connector system is substantially greater than that of the typical flex pin connector, and permits a satisfactory installation fit between a new tooth point and either an essentially unworn adapter nose portion or a partially worn adapter nose portion.

The foregoing detailed description is to be clearly understood as being given by way of illustration and example only, the spirit and scope of the present invention being limited solely by the appended claims.

What is claim is :

1. A material displacement tooth and adapter assembly comprising:

an adapter structure having a base section with a tapered nose portion projecting outwardly therefrom along a first axis, said nose portion having a tapered connector opening extending therethrough in a direction transverse to said first axis;

a replaceable tooth point slidably and releasably telescoped on said nose portion and engaging it along a tapered interface area which, in response to wear thereof, permits said tooth point to be slidably moved in a tightening direction toward said base section, said tooth point having an opposed pair of tapered side wall connector openings positioned on opposite sides of and generally aligned with said nose portion connector opening;

self-tightening means, responsive to wear of said interface area, for automatically creating movement of said tooth point in said tightening direction, said self-tightening means including:

an elongated, generally wedge-shaped connector member longitudinally extending through the aligned tooth point and nose portion connector openings and slidably bearing on oppositely facing interior surface portions thereof, said connector member having a first end, a second smaller than said first end and spaced apart therefrom in a first direction, and a longitudinally extending internal passage opening outwardly through said first end, and force exerting means for continuously exerting a resilient force on said connector member in said first direction in a manner causing it to urge said tooth point in said tightening direction, said force exerting means including a spring member received in said internal passage, and a force exerting member disposed in an outwardly extended position and having a first portion received in said internal passage and compressing said spring member, and a second portion resiliently held in abutment with an interior surface portion of said tooth point by said spring member and blocking removal of said connector member from said tooth point and nose portion connector openings, wherein, from said outwardly extended position, said force exerting member is movable to an inwardly retracted position, by pushing said force exerting member further into said internal passage to further compress said spring member, and rotating said force exerting member about an axis parallel to said first direction, to disengage said second portion of said force exerting member from said interior surface portion of said tooth point and permit removal of said connector member from said tooth point and nose portion connector openings; and cooperatively engageable means on said force exerting member and said connector member for releasably holding said force exerting member in said inwardly retracted position in response to movement of said force exerting member from said outwardly extended position to said inwardly retracted position.

2. The tooth and adapter assembly of claim 1 wherein:

said tooth point is a replaceable excavation tooth point.

3. The tooth and adapter assembly of claim 1 wherein:

said interface area includes two generally planar portions positioned on opposite sides of and essentially parallel to said first axis, said generally planar portions being operative, in response to forcible axial removal of said tooth point from said nose portion, to maintain the removal direction of said tooth point generally parallel to said first axis.

4. The tooth and adapter assembly of claim 1 wherein said cooperatively engageable means include:

a longitudinally extending exterior side surface guiding depression formed in said force exerting member, a longitudinally spaced series of exterior side surface locking depressions formed in said force exerting member and extending generally transversely outwardly from said guiding depression, and a locking projection formed on said connector member and extending generally transversely into said internal passage, said locking projection being received in said guiding depression for movement along its length, and outwardly therefrom into a selected one of said locking depressions, in response to movement of said force exerting member from said outwardly extended position thereof to said inwardly retracted position thereof.

5. The tooth and adapter assembly of claim 4 wherein:

each of said locking depressions has (1) a circumferentially inner end portion which, from its juncture with said guiding depression, is longitudinally sloped away from said spring member, and (2) a circumferentially outer end portion which, from its juncture with said circumferentially inner end portion, is longitudinally sloped toward said spring member.

6. A material displacement tooth and adapter assembly comprising:

an adapter structure having a base section with a tapered nose portion projecting outwardly therefrom along a first axis, said nose portion having a tapered connector opening extending therethrough in a direction transverse to said first axis;

a replaceable tooth point slidably and releasably telescoped on said nose portion and engaging it along a tapered interface area which, in response to wear thereof, permits said tooth point to be slidably moved in a tightening direction toward said base section, said tooth point having an opposed pair of tapered side wall connector openings positioned on opposite sides of and generally aligned with said nose portion connector opening; and self-tightening means, responsive to wear of said interface area, for automatically creating movement of said tooth point in said tightening direction, said self-tightening means including:

an elongated, generally wedge-shaped connector member longitudinally extending through the aligned tooth point and nose portion connector openings and slidably bearing on oppositely facing interior surface portions thereof, said connector member having a first end, a second end smaller than said first end and spaced apart therefrom in a first direction, and a longitudinally extending internal passage opening outwardly through said first end, and force exerting means for continuously exerting a resilient force on said connector member in said first direction in a manner causing it to urge said tooth point in said tightening direction, said force exerting means including a spring member received in said internal passage, and a force exerting member disposed in an outwardly extended position and having a first portion received in said internal passage and compressing said spring member, and a second portion resiliently held in abutment with an interior surface portion of said tooth point by said spring member and blocking removal of said connector member from said tooth point and nose portion connector openings, said second portion of said force exerting member having a transversely enlarged outer end section that faces and abuts said interior surface portion of said tooth point and is configured to be moved out of a facing relationship with said interior surface portion when said force exerting member is moved from said outwardly extended position thereof to said inwardly retracted position thereof, said first end of said connector member having opposite side surfaces, an outer end surface, and a recess extending inwardly through said outer end surface, opening outwardly through said opposite side surfaces, and communicating with a longitudinally outer end of said internal passage, and said outer end section being disposed in said recess, inwardly of said opposite side surfaces of said first end of said connector member, when said force exerting member is in said inwardly retracted position thereof, and projects outwardly from said recess, beyond at least one of said opposite side surfaces, when said force exerting member is in said outwardly extended position thereof.

7. The tooth and adapter assembly of claim 6 wherein:

said recess has a surface area positioned and configured to engage said outer end section of said force exerting member, when said force exerting member is moved to said outwardly extended position thereof, and prevent rotation of said force exerting member further away from its rotational orientation in said inwardly retracted position thereof.

8. Material displacement apparatus comprising:

a replaceable tooth point having a front end, a rear end, an adapter nose pocket extending forwardly along an axis through said rear end and circumscribed by a laterally outer wall portion of said tooth point, and an aligned pair of tapered connector openings formed through opposed sections of said laterally outer wall portion;

an adapter having a forwardly projecting nose portion removably receivable in said adapter nose pocket and engageable with the interior surface thereof along an interface area having oppositely facing tapered portions, said tooth point and said adapter being relatively configured in a manner permitting rearward axial tightening movement of said tooth point relative to said nose portion in response to tooth point/adapter nose portion wear along said tapered interface area portions, said nose portion having a tapered connector opening extending transversely therethrough which is positionable between and generally alignable with said tooth point connector openings;

self-adjusting connector apparatus for releasably retaining said adapter nose portion within said tooth point pocket and exerting a continuous, rearward axial tightening force on said tooth point so that operating wear on said opposite tapered portions of said interface area responsively creates rearward tightening movement of said tooth point along said nose portion, said connector apparatus including:

an elongated connector member having a first end, a smaller second end spaced apart from said first end in a first direction, and longitudinally tapered opposite first and second side surfaces extending between said first and second ends, said connector member being longitudinally insertable, second end first, in an insertion direction into the aligned tapered connector openings in said tooth point and adapter nose portion in a manner causing said tapered opposite first and second side surfaces of said connector member to complementarily and slidably engage opposing surface portions of said tapered connector openings in said tooth point and adapter nose portions, said connector member further having a longitudinally extending internal passage opening outwardly through said first end thereof, a resiliently deformable spring member insertable into said internal passage, and an elongated force exerting member having (1) a first longitudinal portion insertable inwardly into said internal passage, through said first end of said connector member, to resiliently deform said spring member within said internal passage and cause said spring member to exert a resilient outward force on said force exerting member, and (2) a second longitudinal portion positionable against an interior surface portion of said outer wall portion of said tooth point, with said force exerting member being in an outwardly extended position, in a manner utilizing said resilient force to cause said connector member to resiliently bias said tooth point rearwardly along said adapter nose portion, wherein from said outwardly extended position said force exerting member is movable to an inwardly retracted position, by pushing said force exerting member further into said internal passage to further resiliently deform said spring member, and rotating said force exerting member about an axis parallel to said first direction, to disengage said second portion of said force exerting member from said interior surface portion of said tooth point and permit removal of said connector member from said tooth point and nose portion connector openings; and cooperatively engageable means on said force exerting member and said connector member for releasably holding said force exerting member in said inwardly retracted position in response to movement of said force exerting member from said outwardly extended position to said inwardly retracted position.

9. The material displacement apparatus of claim 8 wherein:

said tooth point is a replaceable excavation tooth point.

10. The material displacement apparatus of claim 8 wherein:

said interface area has oppositely disposed surface portions positioned on opposite sides of and extending parallel to said axis to thereby prevent pivoting of said tooth point about an axis perpendicular to said tooth point axis during removal of said tooth point from said nose portion.

11. The material displacement apparatus of claim 8 wherein said cooperatively engageable means include:

a longitudinally extending exterior side surface guiding depression formed in said force exerting member, a longitudinally spaced series of exterior side surface locking depressions formed in said force exerting member and extending generally transversely outwardly from said guiding depression, and a locking projection formed on said connector member and extending generally transversely into said internal passage, said locking projection being receivable in said guiding depression for movement along its length, and outwardly therefrom into a selected one of said locking depressions, in response to movement of said force exerting member from said outwardly extended position thereof to said inwardly retracted position thereof relative to said connector member.

12. The material displacement apparatus of claim 11 wherein:

said second longitudinal portion of said force exerting member has an outer end, and each of said locking depressions has (1) a circumferentially inner end portion which, from its juncture with said guiding depression, is longitudinally sloped toward said outer end of said second longitudinal portion of said force exerting member, and (2) a circumferentially outer end portion which, from its juncture with said circumferentially inner end portion, is longitudinally sloped away from said outer end of said second longitudinal portion of said force exerting member.

13. Material displacement apparatus comprising:

a replaceable tooth point having a front end, a rear end, an adapter nose pocket extending forwardly along an axis through said rear end and circumscribed by a laterally outer wall portion of said tooth point, and an aligned pair of tapered connector openings formed through opposed sections of said laterally outer wall portion;

an adapter having a forwardly projecting nose portion removably receivable in said adapter nose pocket and engageable with the interior surface thereof along an interface area having oppositely facing tapered portions, said tooth point and said adapter being relatively configured in a manner permitting rearward axial tightening movement of said tooth point relative to said nose portion in response to tooth point/adapter nose portion wear along said tapered interface area portions, said nose portion having a tapered connector opening extending transversely therethrough which is positionable between and generally alignable with said tooth point connector openings; and self-adjusting connector apparatus for releasably retaining said adapter nose portion within said tooth point pocket and exerting a continuous, rearward axial tightening force on said tooth point so that operating wear on said opposite tapered portions of said interface area responsively creates rearward tightening movement of said tooth point along said nose portion, said connector apparatus including:

an elongated connector member having a first end, a smaller second end spaced apart from said first end in a first direction, and longitudinally tapered opposite first and second side surfaces extending between said first and second ends, said connector member being longitudinally insertable, second end first, in an insertion direction into the aligned tapered connector openings in said tooth point and adapter nose portion in a manner causing said tapered opposite first and second side surfaces of said connector member to complementarily and slidably engage opposing surface portions of said tapered connector openings in said tooth point and adapter nose portions, said connector member further having a longitudinally extending internal passage opening outwardly through said first end thereof, a resiliently deformable spring member insertable into said internal passage, and an elongated force exerting member having (1) a first longitudinal portion insertable inwardly into said internal passage, through said first end of said connector member, to resiliently deform said spring member within said internal passage and cause said spring member to exert a resilient outward force on said force exerting member, and (2) a second longitudinal portion positionable against an interior surface portion of said outer wall portion of said tooth point, with said force exerting member being in an outwardly extended position, in a manner utilizing said resilient force to cause said connector member to resiliently bias said tooth point rearwardly along said adapter nose portion, said second longitudinal portion of said force exerting member having a transversely enlarged outer end section that is positionable to face and abut said interior surface portion of said tooth point when said force exerting member is in said outwardly extended position thereof, and to be moved out of a facing relationship with said interior surface portion when said force exerting member is moved from said outwardly extended position thereof to said inwardly retracted position thereof, said first end of said connector member having opposite side surfaces, an outer end surface, and a recess extending inwardly through said outer end surface, opening outwardly through said opposite side surfaces, and communicating with a longitudinally outer end of said internal passage, and said outer end section of said force exerting member being disposed in said recess, inwardly of said opposite side surfaces of said first end of said connector member, when said force exerting member is in said inwardly retracted position thereof, and projects outwardly from said recess, beyond at least one of said opposite side surfaces, when said force exerting member is in said outwardly extended position thereof.

14. The material displacement apparatus of claim 13 wherein:

said recess has a surface area positioned and configured to engage said outer end section of said force exerting member, when said force exerting member is moved to said outwardly extended position thereof, and prevent rotation of said force exerting member further away from its rotational orientation in said inwardly retracted position thereof.

15. Apparatus for use in removably coupling a replaceable material displacement tooth point to an adapter nose structure received in an internal pocket area of said tooth point, said tooth point and said nose structure having generally alignable connection openings therein, said apparatus comprising a generally wedge-shaped connector member insertable into the aligned connection openings and having:

a first end having an outer end surface;

a smaller second end longitudinally spaced apart from said first end;

first and second opposite sides extending between said first and second ends and being laterally inwardly sloped from said first end to said second end;

third and fourth generally parallel opposite sides extending between said first and second opposite sides;

a recess extending longitudinally inwardly through said outer end surface of said first end and opening outwardly through at least one of said third and fourth sides, said recess having an inner end surface; and an internal passage extending longitudinally inwardly from said inner recess end surface and configured to coaxially receive a compression spring member.

16. The apparatus of claim 15 further comprising:

a compression spring member received in said internal passage.

17. The apparatus of claim 16 further comprising:

retention means for captively retaining said compression spring member in said internal passage.

18. The apparatus of claim 17 wherein said retention means include:

a pin member having a longitudinal portion projecting generally transversely into said internal passage and preventing removal of said spring member from said internal passage.

19. The apparatus of claim 15 further comprising:

a force exerting member having a first longitudinal portion removably insertable through said recess into said internal passage to compress a spring member disposed therein, and a second portion configured to project outwardly from said internal passage, through said recess, and be spring-biased outwardly against an interior surface portion of said tooth point.

20. The apparatus of claim 19 wherein:

said connector member has a projection formed thereon and projecting generally transversely into said internal passage, and said first and second longitudinal portions of said force exerting member have outer ends, and said force exerting member further has a longitudinally extending exterior side surface guiding depression configured to slidingly receive said projection to permit said force exerting member to move into and out of said internal passage, and a longitudinally spaced series of exterior side surface locking depressions and extending generally transversely outwardly from said guiding depression, each of said locking depressions being configured to receive said projection to longitudinally lock said force exerting member relative to said connector member with a selectively variable longitudinal length of said force exerting member extending into said internal passage.

21. The apparatus of claim 20 wherein:

each of said locking depressions has (1) a circumferentially inner end portion which, from its juncture with said guiding depression, is longitudinally sloped away from said outer end of said first longitudinal portion of said force exerting member, and (2) a circumferentially outer end portion which, from juncture with said circumferentially inner end portion is longitudinally sloped toward said outer end of said first longitudinal portion of said force exerting member.

22. Apparatus for use in removably coupling a replaceable material displacement tooth point to an adapter nose structure received in an internal pocket area of said tooth point, said tooth point and said nose structure having generally alignable connection openings into which a generally wedge-shaped connector member is inserted, said apparatus comprising a force exerting member removably securable to an end of the connector member and including:

an elongated, generally cylindrical body having a first end, a transversely enlarged second end having a longitudinally inner side, and a tab portion positioned inwardly adjacent said inner side and projecting laterally outwardly beyond said transversely enlarged second end;

a longitudinally extending first exterior side surface depression formed on said body; and a longitudinally spaced series of generally circumferentially extending locking depressions formed on said body and extending generally transversely outwardly from said first exterior side surface depression.

23. The apparatus of claim 22 wherein:

each of said locking depressions has (1) a circumferentially inner end portion which, from its juncture with said guiding depression, is longitudinally sloped away from said first end of said body, and (2) a circumferentially outer end portion which, from its juncture with said circumferentially inner end portion, is longitudinally sloped toward said first end of said body.

* * * * *